US010197364B1

(12) United States Patent
Christ

(10) Patent No.: US 10,197,364 B1
(45) Date of Patent: Feb. 5, 2019

(54) DEMINING DEVICE

(71) Applicant: Gary W Christ, Crystal Lake, IL (US)

(72) Inventor: Gary W Christ, Crystal Lake, IL (US)

( * ) Notice: Subject to any disclaimer, the term of this patent is extended or adjusted under 35 U.S.C. 154(b) by 665 days.

(21) Appl. No.: 14/671,478

(22) Filed: Mar. 27, 2015

(51) Int. Cl.
*F41H 11/16* (2011.01)
*F41H 11/18* (2011.01)

(52) U.S. Cl.
CPC ..... *F41H 11/18* (2013.01); *F41H 11/16* (2013.01)

(58) Field of Classification Search
CPC ..... F41H 11/12; F41H 11/16; F41H 11/18; G06G 7/76; E02F 7/00; G01C 21/20; B66F 9/20; B66F 9/22; B66F 9/08; B66F 9/00; B62D 21/00; B62D 21/17
USPC ..... 89/1.13; 102/402; 700/245, 257; 701/2, 701/50, 36, 37, 41
See application file for complete search history.

(56) References Cited

U.S. PATENT DOCUMENTS 2,425,018 A * 8/1947 Williams ..... F41H 11/18 172/84
2,425,357 A * 8/1947 Walker ..... F41H 11/18 172/117
4,590,844 A * 5/1986 Bar-Nefy ..... E02F 3/76 171/141
4,690,030 A * 9/1987 Bar-Nefy ..... E02F 3/76 171/141
4,862,969 A * 9/1989 Jobst ..... A01B 33/00 172/108
5,007,325 A * 4/1991 MacWatt ..... F41H 11/18 89/1.13
5,856,629 A * 1/1999 Grosch ..... F41H 11/18 102/402
5,979,289 A * 11/1999 French ..... F41H 11/18 102/402
5,979,290 A * 11/1999 Simeone ..... F41H 11/16 102/403
6,892,622 B2 * 5/2005 Watson ..... F41H 11/16 102/402
7,182,011 B2 * 2/2007 Lowery ..... F41H 11/20 89/1.13
2004/0035285 A1 * 2/2004 Renwick ..... F41H 11/30 89/1.13
2007/0272074 A1 * 11/2007 Kim ..... F41H 11/18 89/1.13

(Continued)

FOREIGN PATENT DOCUMENTS

CN 101934783 A * 1/2011 ..... B60S 9/20
FR 2343639 A1 * 10/1977 ..... B62D 7/1509
GB 1317810 A * 5/1973 ..... C21C 5/4686

OTHER PUBLICATIONS

NPL: Christ, Gary "From Church Mission to Invention"; http://www.jmu.edu/cisr/journa1/17.2/feature/christ/christ.shtml; Summer 2013.*

(Continued)

*Primary Examiner* — Jonathan C Weber
(74) *Attorney, Agent, or Firm* — Mathew R. P. Perrone, Jr.; Joseph Whang

(57) ABSTRACT

A demining device has a controlled detonator or hammer assembly mounted on a ram drive; which, when it is used as a demining device, permits efficient elimination of a minefield with minimal danger to the operator of the tractor, and which can be easily assembled from parts on hand or otherwise used with a device for exploding mines in a minefield.

7 Claims, 10 Drawing Sheets

(56) References Cited

U.S. PATENT DOCUMENTS

| | | | | |
|---|---|---|---|---|
| 2009/0038186 | A1* | 2/2009 | Osswald | B62D 21/14<br>37/413 |
| 2009/0206589 | A1* | 8/2009 | Osswald | B62D 21/14<br>280/782 |

OTHER PUBLICATIONS

NPL: Sloan, Michael "Inventor Hammers Out a De-Mining Machine"; http://www.phnompenhpost.com/siem-reap-insider/inventor-hammers-out-de-mining-machine; Apr. 29, 2011.*

* cited by examiner

DEMINING DEVICE

This invention relates to a demining device and more particularly to a demining device including a controlled detonator or hammer assembly mounted on a ram drive tractor; which, when it is used as a demining device, permits efficient elimination of a minefield with minimal danger to the operator of the tractor.

BACKGROUND OF THE INVENTION

Leftover from many conflicts, such as wars or battles, are minefields. By concealing an explosive device such as a mine; usually underground, with a trigger protruding therefrom above the ground or concealed but still capable of being activated from the ground surface; passage of military assets including personnel or equipment through a certain area can be prevented, or at least rendered more difficult, due to the triggered or exploded mines.

While minefields have a use for military purposes, a minefield is very dangerous for the civilian population. So since the time of the United States Civil War, when mines were used extensively for the first time in war, prevention of civilian casualties from the minefield has proven difficult—especially after the war is over.

Among the types of demining are military demining and humanitarian demining. Military demining finds acceptable the elimination of about ninety percent of the mines in a minefield. Humanitarian demining finds acceptable the elimination of at least ninety nine percent of the mines in a minefield, which makes this demining process more difficult.

Many devices are known to detect mines and assist with the neutralization or safe detonation thereof. These devices are complex and difficult to operate. Such devices also do not offer adequate protection to the user thereof. Furthermore, the user needs effective training to use such devices. This brings into the mine detection process an element of skill that can be hard to find or teach.

Even today, there are many problems in the world with minefields leftover from the various wars. It is quite common to see people in Cambodia or Myanmar (formerly known as Burma) who have lost body parts, such as limbs, to a mine explosion in a minefield leftover from the Vietnam War. Such problems have an adverse effect on the people themselves, as well as the country as a whole.

If a device or apparatus can be developed to detonate the mines in a minefield, without exposing the operator of the device or other people to unreasonable danger, great advantages can be obtained. Not only can injuries or death be prevented, but also the land now cleared of the minefield can be put to better use. Furthermore if that device or apparatus is relatively inexpensive and easy to operate, the teaching element and skill element can be reduced, thereby providing a greater number of operators and devices to work toward eliminating the minefield danger.

Typically, a demining device is heavy. To move that device to a desired area to carry out a demining function is difficult. Furthermore, such movement must be done carefully and efficiently. To that end, it is very desirable to have a device that can move such heavy loads a short distance.

It is also very useful for the driving mechanism to be easily assembled from parts or material readily available. The simpler the parts are, the more likely the device is to be made and used. Combined with simplicity, the device thus becomes very successful and very useful. However, such a combination of simplicity and usability is difficult to achieve.

SUMMARY OF THE INVENTION

Among the many objectives of the present invention is the provision of a demining device having a ram drive tractor with a controlled detonator or hammer assembly mounted thereon to safely explode the mines in a minefield.

Another objective of the present invention is the provision of a ram drive, articulated tractor, which can be easily assembled.

Yet another objective of the present invention is the provision of a ram drive, articulated tractor, which has a simple structure.

Still another objective of the present invention is the provision of a ram drive, articulated tractor, which can detonate a mine or plurality of mines, while protecting an operator of the tractor.

Also an objective of the present invention is the provision of a ram drive, articulated tractor, which is useful in a minefield.

A further objective of the present invention is the provision of a ram drive, articulated tractor, which is flexible to receive various tools to minimize the danger of a minefield.

A still further objective of the present invention is the provision of a demining device using a ram drive, articulated tractor with a controlled detonator assembly mounted thereon to safely explode the mines in a minefield.

Yet a further objective of the present invention is the provision of a demining device, which can be easily assembled.

Also an objective of the present invention is the provision of a demining device, which has a simple structure.

Another objective of the present invention is the provision of a demining device, which can detonate a mine or plurality of mines, while protecting an operator of the tractor.

Still another objective of the present invention is the provision of a demining device, which is useful in a minefield.

Yet another objective of the present invention is the provision of a demining device, which is flexible to receive various tools to minimize the danger of a minefield.

Also an objective of the present invention is the provision of a demining device, which can move a heavy load over a short distance efficiently.

A further objective of the present invention is the provision of a demining device having a ram drive, articulated tractor with a controlled detonator assembly mounted thereon to safely explode the mines in a minefield.

Another objective of the present invention is the provision of a ram drive, articulated tractor, which can be easily assembled.

Yet another objective of the present invention is the provision of a ram drive tractor, which has a simple structure.

Still another objective of the present invention is the provision of demining device using a ram drive tractor, which can detonate a mine or plurality of mines, while protecting an operator of the tractor.

Also an objective of the present invention is the provision of a ram drive tractor, which is useful in a minefield.

A further objective of the present invention is the provision of a ram drive tractor, which is flexible to receive various tools to minimize the danger of a minefield.

A still further objective of the present invention is the provision of a demining device using a ram drive tractor with a controlled detonator or hammer assembly mounted thereon to safely explode the mines in a minefield.

These and other objectives of the invention (which other objectives become clear by consideration of the specification, claims and drawings as a whole) are met by demining device having controlled detonator or hammer assembly mounted on a ram drive tractor, which can be easily assembled from parts on hand or otherwise used with a device for exploding mines in a minefield.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
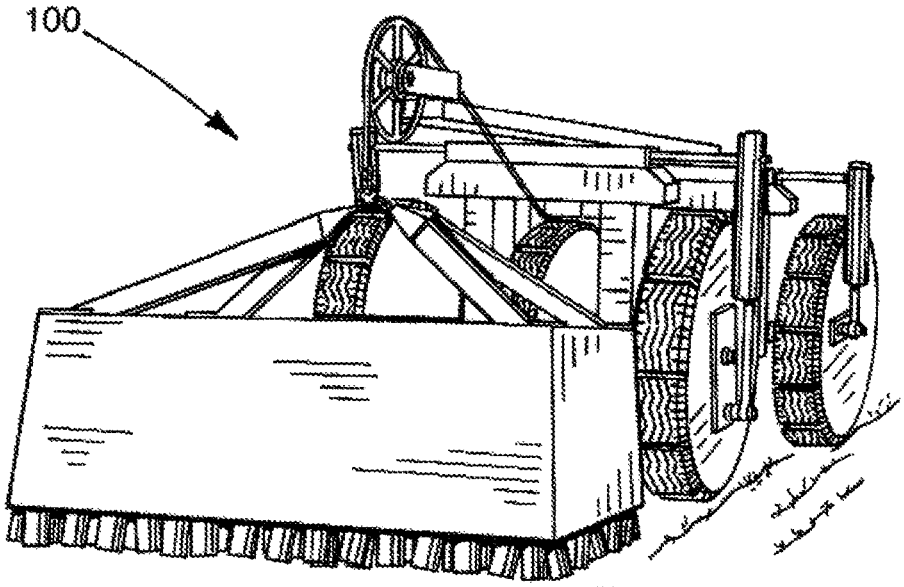
FIG. 1 depicts a front perspective view of demining device 100 with a detonator assembly 104 mounted on a ram drive, articulated tractor 106.
Figure 2:
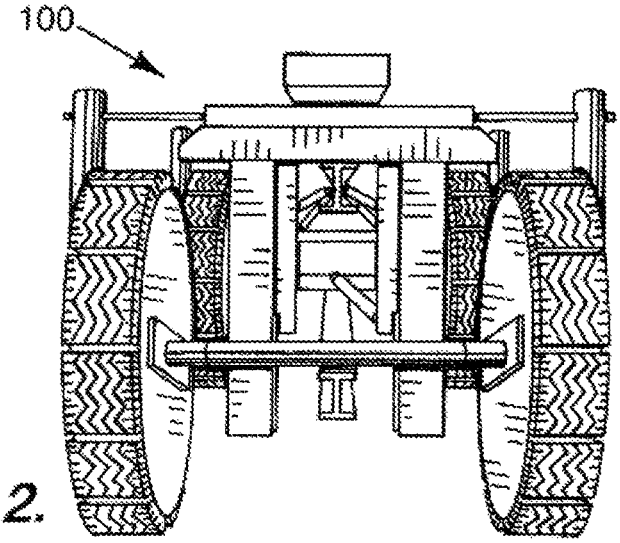
FIG. 2 depicts a rear perspective view of demining device 100 based on FIG. 1.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The demining device has a detonator assembly mounted on a ram drive tractor to provide for a faster, more efficient removal of the landmines in a minefield. The tractor can also be a ram drive, articulated tractor includes a first axle and a second axle relative to articulated beams. The two axles can cooperate to assist the articulated fashion with an appropriate cylindrical structure.

The drive mechanism on the front wheels is offset from the drive mechanism on the rear wheels by about 90 degrees to achieve more effective use of engine power. Also, such a structure achieves a four wheel drive vehicle. The crankshaft permits use of much less torque to turn the wheel when the crankshaft is used as an axle.

The wheels on the ram drive, articulated tractor can be formed in any suitable fashion. Preferably, the wheels are formed of wood with scraps of tires cut into pieces and attached thereto, in order to provide an efficient ground contact for the ram drive, articulated tractor.

Turning now to FIG. 1, FIG. 2, FIG. 8 and FIG. 9, the demining device 100 has a ram drive, articulated tractor 106 with a detonator assembly 104. The detonator assembly 104 includes a box or shield 108 capable of contacting the ground or surface 110 (FIG. 3) with a hammer assembly 112 contained in the shield 108 as part of the detonator assembly 104. Ram drive, articulated tractor 106 supports the detonator assembly 104.

Figure 3:
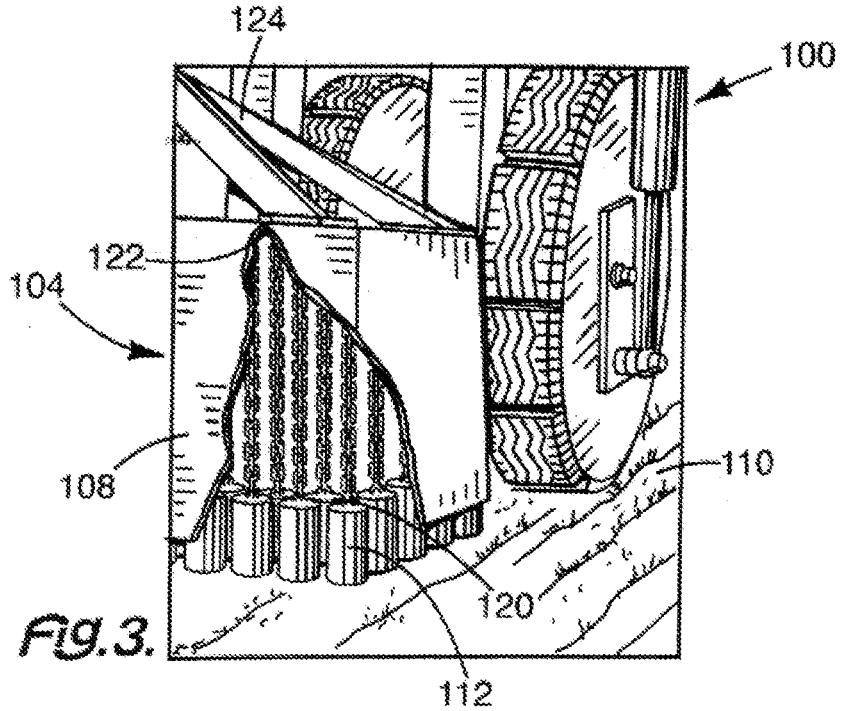
FIG. 3 depicts a front perspective, close-up, partially cutaway view of demining device 100 with a detonator assembly 104 mounted on ram drive, articulated tractor 106.
Figure 4:
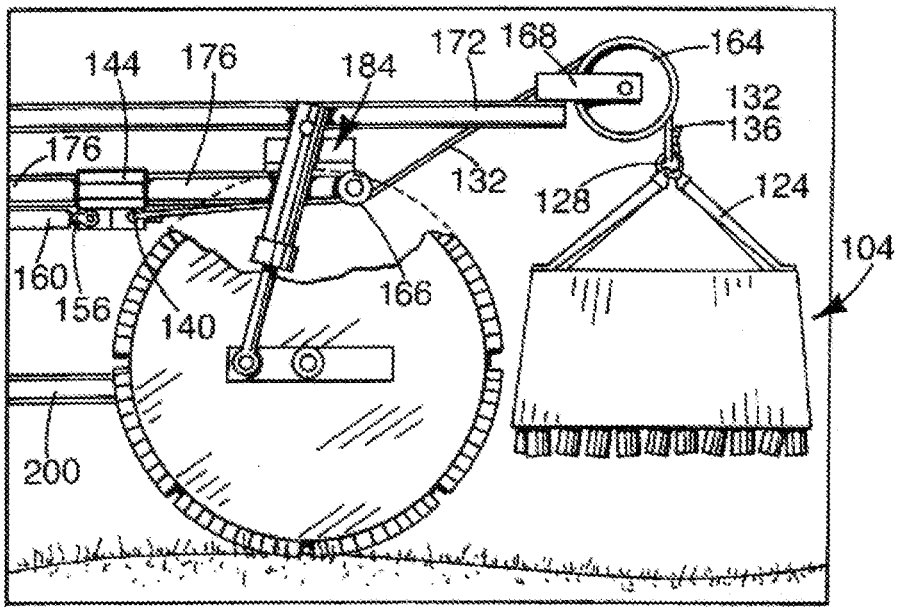
FIG. 4 depicts a partial side view of detonator assembly 104 and its relationship to demining device 100 with lift cable 132.
Figure 5:
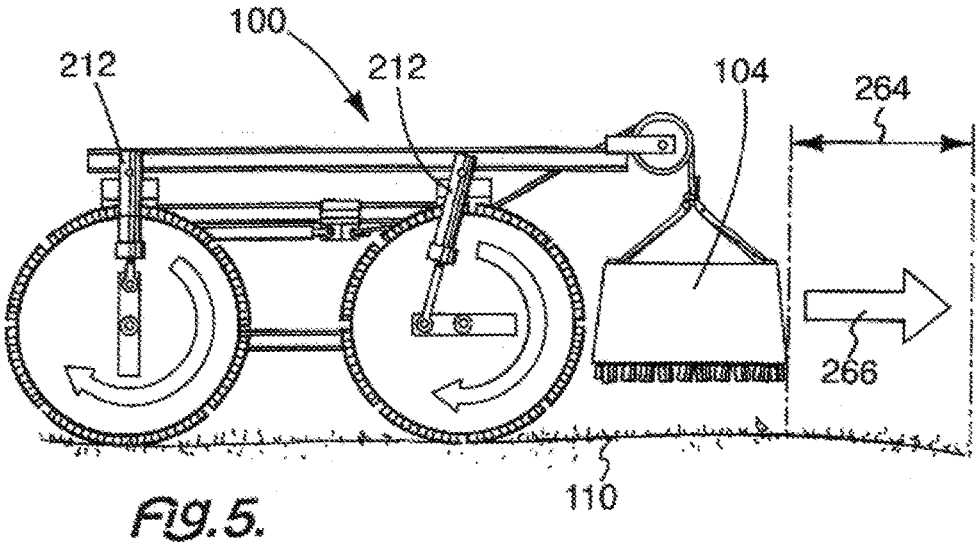
FIG. 5 depicts a side view of demining device 100 advancing forward in increments of the box or shield depth 264 by means of each of its drive cylinders 212.
Figure 8:
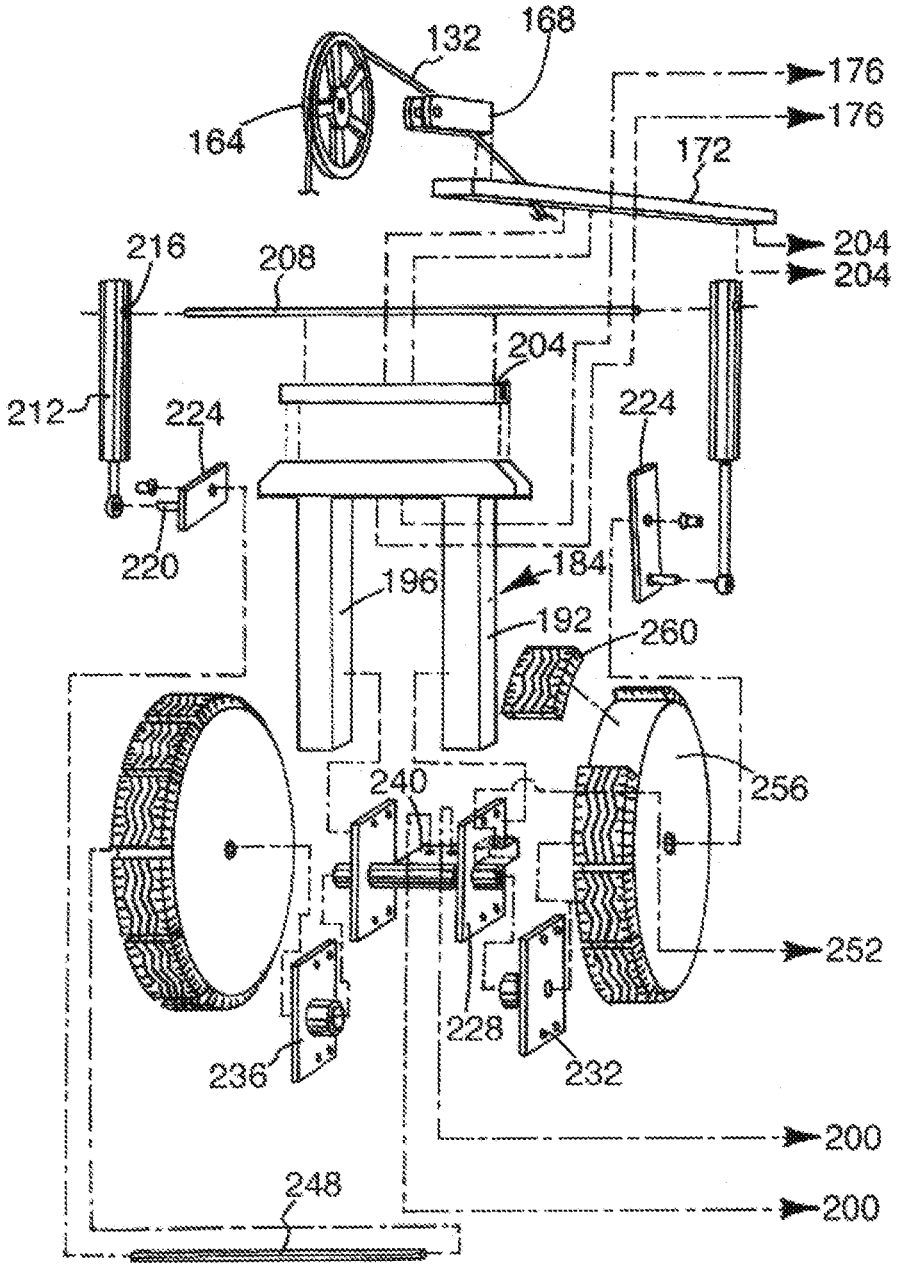
FIG. 8 depicts a front exploded view of the demining device 100 in general and the ram drive, articulated tractor 106 in particular.
Figure 9:
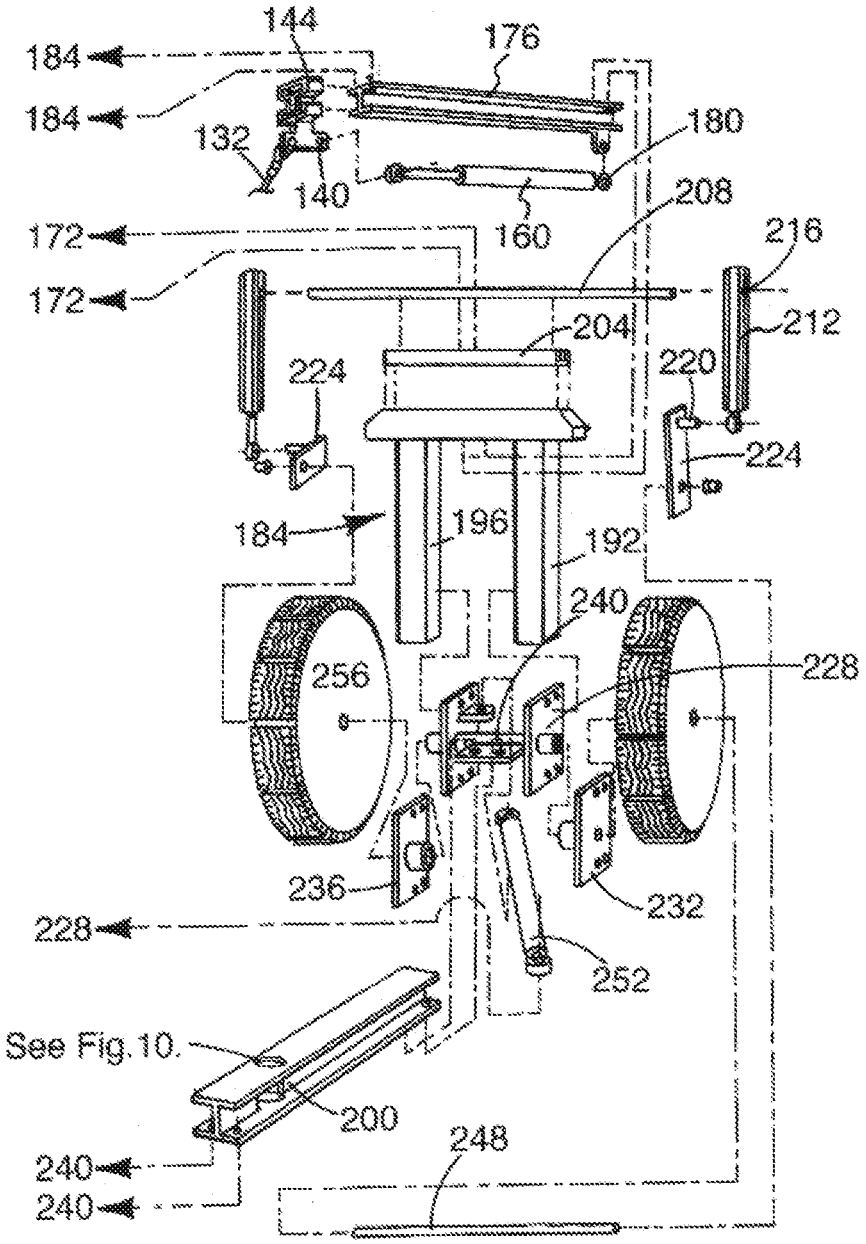
FIG. 9 depicts a rear exploded view of the demining device 100 in general and the ram drive, articulated tractor 106 in particular.

Adding FIG. 3, FIG. 4, FIG. 5, Figure, FIG. 8 and FIG. 9 to the consideration, a cut-away view of the hammer assembly 112 in detonator assembly 104 and its relationship to the ram drive, articulated tractor 106 forms the demining device 100. The detonator assembly 104 has the hammer assembly 112 in box or shield 108. As the box or shield 108 strikes ground or surface 110, so does the hammer assembly 112. Blows from the hammer assembly 112 on the ground or surface 110 can cause the detonation dust cloud 134 of FIG. 6 due to the explosion of mines (not shown).

Figure 6:
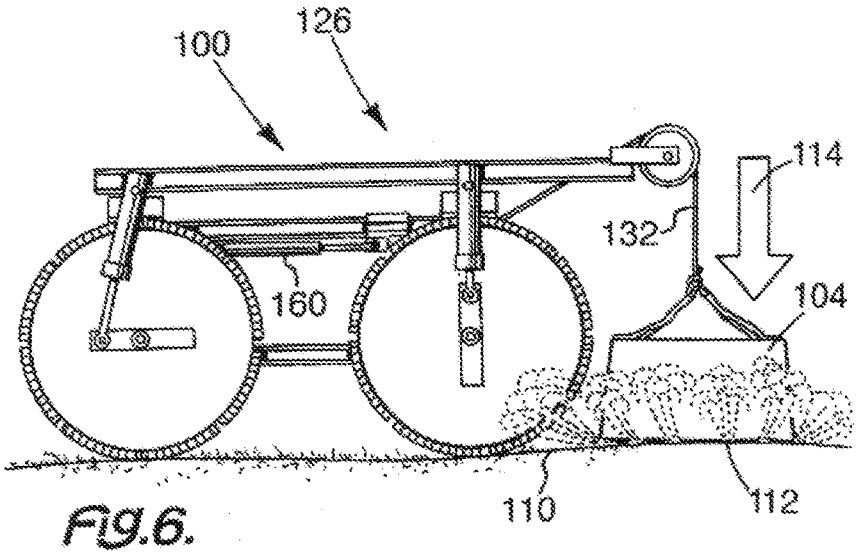
FIG. 6 depicts a side view of demining device 100 stopping in an area of a ground or surface 110 to be demined.

FIG. 6 shows demining device 100 stopping at a small area to be demined. Here the demining device 100 has instantly released the tension hold on its lift cable 132 by command of control cylinder 160. That action causes the dropping of the detonator assembly 104 with full force of its weight on to the ground or surface 110, thereby further causing each hammer in the hammer assembly 112 to slam hard enough with a greater force than required to detonate the mine. This action, shown by downward movement arrow 114 (FIG. 4), causes a mine to explode safely, without causing human injuries or vehicle damage.

Within the detonator assembly 104, and the hammer assembly 112 in particular, a hammer 116 is a heavy object on a chain 118. Hammer 116 is secured at one end of chain 118 as a tethered end 120. At the other end of chain 118 is anchored end 122 securing the chain 118 within the hammer assembly 112 and more particularly box or shield 108. Support sling 124 mounts detonator assembly 104 on ram drive, articulated tractor 106. While chain 118 is preferred, any strong, flexible length of material; which can support the desired weight is operable as a replacement for chain 118.

In the describing of FIG. 4, FIG. 5, FIG. 6, FIG. 8 and FIG. 9, the use of demining device 100 becomes clearer. FIG. 4 has a depiction of a cut-a-way view of lift cable 132 and its interaction with detonator assembly 104 by means of cable pulley 164 as routed by guide pulley 166 with commands from control cylinder 160. FIG. 5 features a profile view of demining device 100 advancing forward in increments of the box or shield depth 162 by means of each of its four drive cylinders 212, ultimately clearing a mine free path along the ground surface 110 of mines, by dropping the hammer assembly 112 on a next or adjoining ground surface 110, and repeating the motion until a desired area is substantially free of mines.

Detonator assembly 104 is mounted on ram drive, articulated tractor 106. With the detonator assembly 104, the box or shield 108 thereof permits striking of the ground or surface 110 with the hammer assembly 112 framed by the box or shield 108. The striking provides a detonation as support sling 124 permits the hammer assembly 112 to reach and contact the ground or surface 110 as shown with downward movement arrow 114, thereby safely detonating any mines thereunder and creating dust cloud 134.

Lift coupling 128 connects lift cable 132 to the detonator end 136 of cable 132 through support sling 124. Cable control cylinder end 140 permits lift or release travel bracket 144 to drop the detonator assembly 104 to the ground or surface 110, thereby causing detonation of any mines under the detonator assembly 104. The lift or release travel bracket 144 also raises the detonator assembly 104, so that it can be moved over or to the next ground or surface 110 desired to be cleared.

Control shaft aperture 152 permits control shaft 156 in control cylinder 160 to activate cable 132 in order to move the detonator assembly 104 up or down as desired. Cable pulley 164 cooperates with guide pulley 166 as pulley bracket 168 supports cable pulley 164. The lift boom 172 supports the pulley bracket 168. The strut tower 184 supports the lift boom 172.

The upper keel beam 176 supports the strut tower 184 and the lift or release travel bracket 144. As the lift or release travel bracket 144 moves along the upper keel beam 176, the detonator assembly 104 is raised or lowered as desired.

The upper keel beam 176 rests on and may be secured to the front strut tower 184 and the rear strut tower 186. Each of the front strut tower 184 and the rear strut tower 186 supports a drive cylinder 212. The drive cylinder 212 on the front strut tower 184 is offset from the drive cylinder 212 on the rear strut tower 186 in the attachment to the respective wheel 256, which assists the power and movement of tractor 106. Then the ram drive, articulated tractor 106 can move the detonator assembly 104 into a possible mine area 264. Thus ram drive, articulated tractor 106 can move in the desired tractor direction 266.

Preferably, the offset of front drive cylinder 212 relative rear drive cylinder 212 is about 70 degrees to about 100 degrees. More preferably, the offset of front drive cylinder 212 relative rear drive cylinder 212 is about 80 degrees to about 95 degrees. Most preferably, the offset of front drive cylinder 212 relative rear drive cylinder 212 is about 85 degrees to about 95 degrees.

Figure 7:
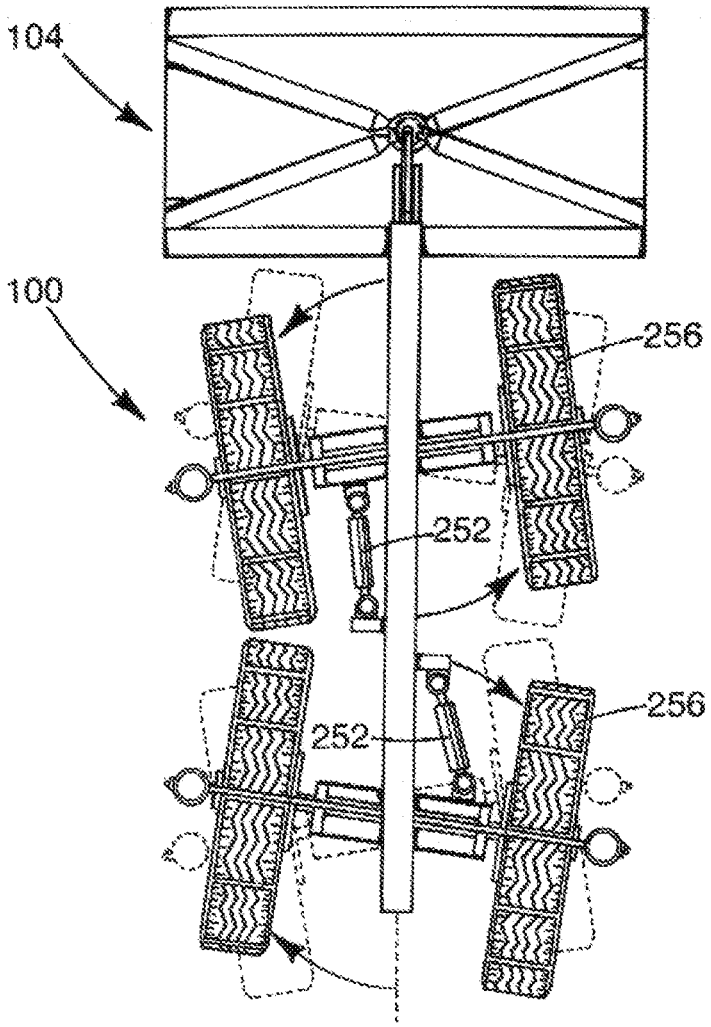
FIG. 7 depicts a top plan view of demining device 100 and its steering capabilities.

With the additional consideration of FIG. 7, FIG. 8 and FIG. 9, the use of first steering cylinder 252 for the detonator assembly 104 and the ram drive, articulated tractor 106 becomes clear. In FIG. 7, an overview of demining device 100 shows and its steering capabilities, with the use of two separate steering cylinders. First steering cylinder 252 and second steering cylinder 254 may be the same or different, but separate or joint use thereof permits great flexibility. The operator 350 (FIG. 14) is able to achieve several steering attitudes.

For example it possible to direct ram drive, articulated tractor 106 as follows: steer from the front axle 270 with the back axle 272 remaining static; steer from the rear axle 272 with the front axle 270 remaining static; steer the rear axle 272 and the front axle 270 in opposite directions to shorten the turning radius; or steer the rear axle 272 and the front axle 270 in the same direction to steer in an oblique direction.

In FIG. 8 and FIG. 9 ram drive, articulated tractor 106 for the demining device 100 has cable control cylinder end 140 cooperating with lift or release travel bracket 144. Supporting the cable pulley 164 is the pulley bracket 168. The pulley bracket 168 is secured on and supported by the lift boom 172. In the ram drive, articulated tractor 106, the upper keel beam 176 has secured thereto the control cylinder mount 180 to support the control cylinder 160. The control cylinder 160 operates the lift cable 132 with cable control cylinder end 140.

The front strut tower 184 and the rear strut tower 186 each support an end of the upper keel beam 176, which is secured to a central portion thereof as part of a frame for the ram drive, articulated tractor 106. Each of the front strut tower 184 and the rear strut tower 186 is supported at each end thereof by the right riser 192 and the left riser 196 respectively.

Also, on the top of each of the front strut tower 184 and the rear strut tower 186 is a hinge shaft cradle beam 204. Mounted within each hinge shaft cradle beam 204 is a hinge shaft 208. Secured to each end of each hinge shaft 208 is drive cylinder 212 through a cylinder hinge aperture 216. Cylinder shaft attachment 220 is a rod shaped member design to be received by cylinder actuating aperture 222. Cylinder shaft attachment 220 is mounted on a wheel crank bracket 224, which receives an end of axle shaft 248.

One of the two axle mount collars 228 cooperates with the right wheel flange 232, while the second of the two axle mount collars 228 cooperates with the left wheel flange 236 to support axle shaft 248. Also as a part of the frame for the ram drive, articulated tractor 106 is the lower keel beam 200. The lower wheel mount 240 is attached to the lower keel beam 200 and supports the tubular front axle 270. Front axle 270 receives axle shaft 248 in the tubular portion thereof. Thus the axle shaft 248 has a wheel 256 at each end thereof. In order to be used in countries like Myanmar and Cambodia, wheel 256 may be made of wood and have a plurality of recycled tire segments 260 nailed, glued or otherwise secured thereto.

Considering FIG. 7, FIG. 8 and FIG. 9 together, mounting bracket 244 on left wheel flange 236 and right wheel flange 232 supports each end of front axle 270. First steering cylinder 252 and second steering cylinder 254 cooperate with wheels 256 to permit turning of ram drive, articulated tractor 106. First steering cylinder 252 and second steering cylinder 254 are connected at one end to outer collar flange 258 on front axle 270, and at the other end to inner collar flange 262 on rear axle 272. Joint or separate activation of first steering cylinder 252 and second steering cylinder 254 permit turning of ram drive, articulated tractor 106.

Front axle 270 and rear axle 272 have a similar structure. Each have a permitted turning of ram drive, articulated tractor 106. As above mentioned, a part of the frame for the ram drive, articulated tractor 106 is the lower keel beam 200. The lower wheel mount 240 is attached to the lower keel beam 200 and supports the tubular front axle 270. Rear axle 272 receives axle shaft 248 in the tubular portion thereof. Thus the axle shaft 248 has a wheel 256 at each end thereof. In fact, with front axle 270 and rear axle 272 having a wheel at each end thereof, there are four wheels 256 in use.

Front axle 270 and rear axle 272, each with a wheel 256 on opposing ends thereof, have a ram drive set up with front drive cylinders 212 being about 90 degrees offset from rear drive cylinders.

Switching to a discussion of FIG. 10, FIG. 11, FIG. 12, and FIG. 13, a steering pad assembly 300 permits effective steering of ram drive, articulated tractor 106. The steering pad assembly 300 has a tractor support pad 310 secured to an upper keel beam 176 of ram drive, articulated tractor 106. Oppositely disposed therefrom is the ground contact pad 324. Between the ground contact pad 324 and the tractor support pad 310 is a hydraulic lifting cylinder 314. Hydraulic lifting cylinder 314 has a tractor support rod 316 feeding into a hydraulic lifting cylinder 314. As a tractor support rod 316 extends, ram drive, articulated tractor 106 is lifted.

Within tractor support pad 310 is a standard rotating mechanism secured to the hydraulic lifting cylinder 314 at the center thereof, which can rotate ram drive, articulated tractor 106 in a desired direction when ram drive, articulated tractor 106 is raised and lower the same when the turning is complete. Ram drive, articulated tractor 106 may then proceed in its desired direction.

Such positioning flexibility permits ram drive, articulated tractor 106 to head in a desired direction. Such close quarters maneuverability permits effective use of the ram drive, articulated tractor 106 and the demining device 100 in a minefield.

Figure 10:
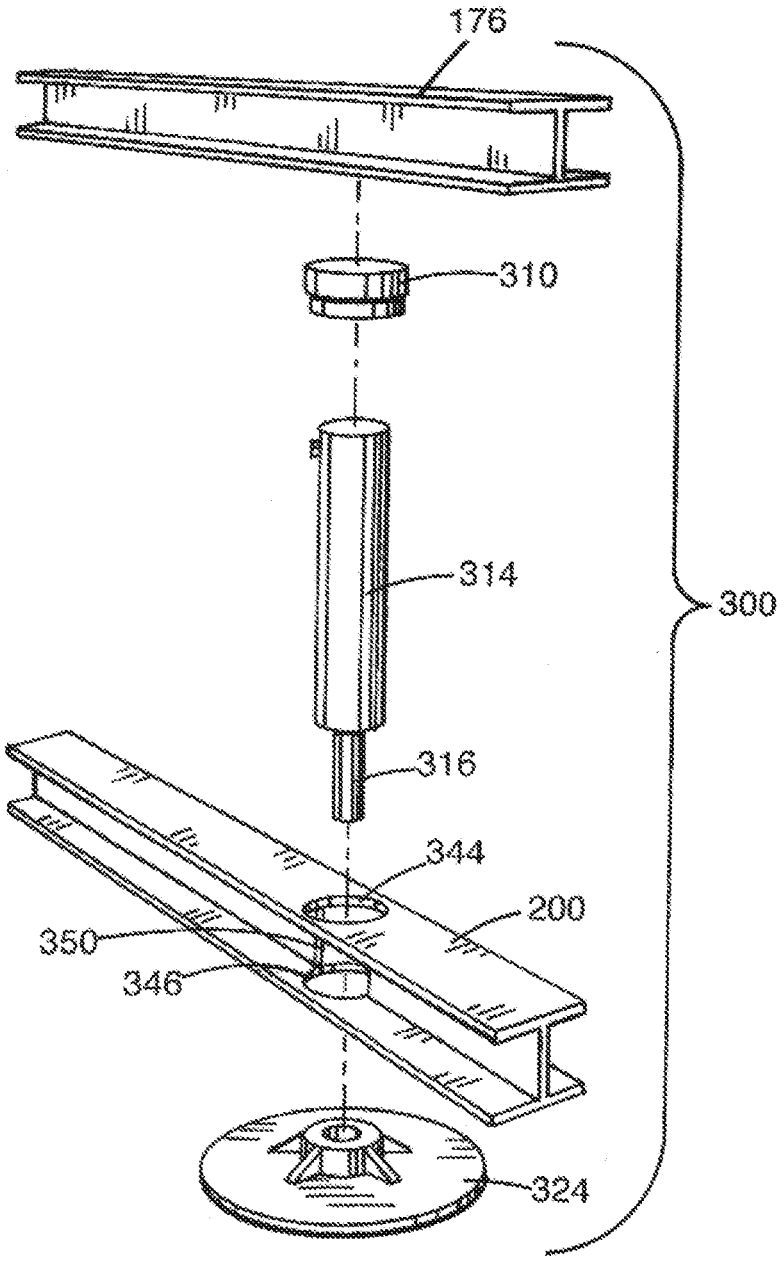
FIG. 10 depicts a perspective view of ram drive, articulated tractor 106 for demining device 100 showing an exploded steering pad assembly 300 mounted thereunder as further shown in FIG. 11.
Figure 11:
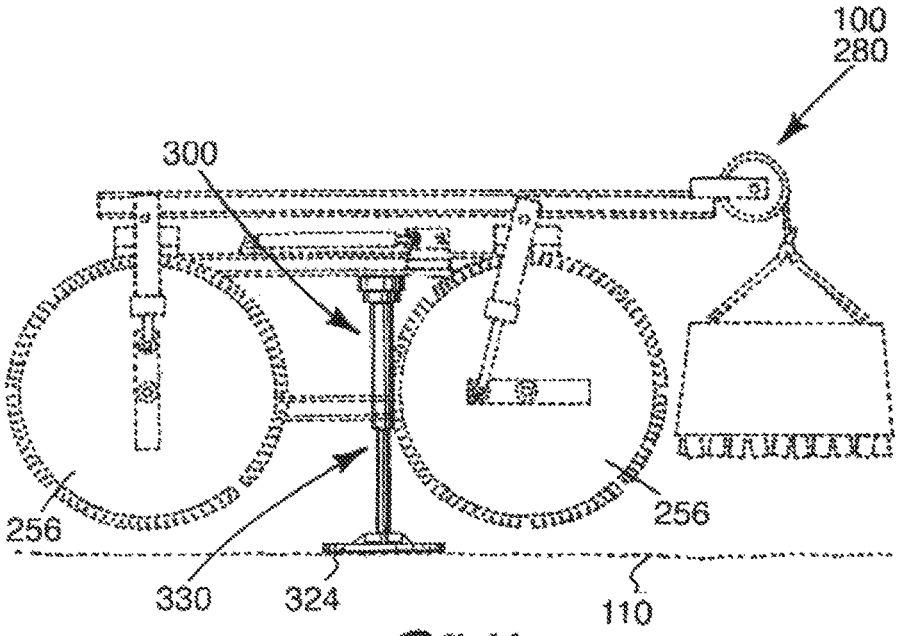
FIG. 11 depicts a side view of ram drive, articulated tractor 106 with a steering pad assembly 300 deployed and mounted thereunder.

As can be seen in FIG. 10, lower keel beam 200 for this modification as therein an upper aperture 344 concentric with lower aperture 346. These concentric apertures receive hydraulic lifting cylinder 314, and support the same within the lower keel beam 200. Support rod 316 feeds into the hydraulic lifting cylinder 314 at one end thereof and receives ground plate 324 at the other end thereof.

As support rod 316 is deployed, ground plate 324 contacts the ground and lifts tractor 106 as desired. Rotation of the hydraulic lifting cylinder 314 permits tractor 106 to head in a desired direction, when the support rod 316 is retracted into hydraulic lifting cylinder 314.

Figure 14:
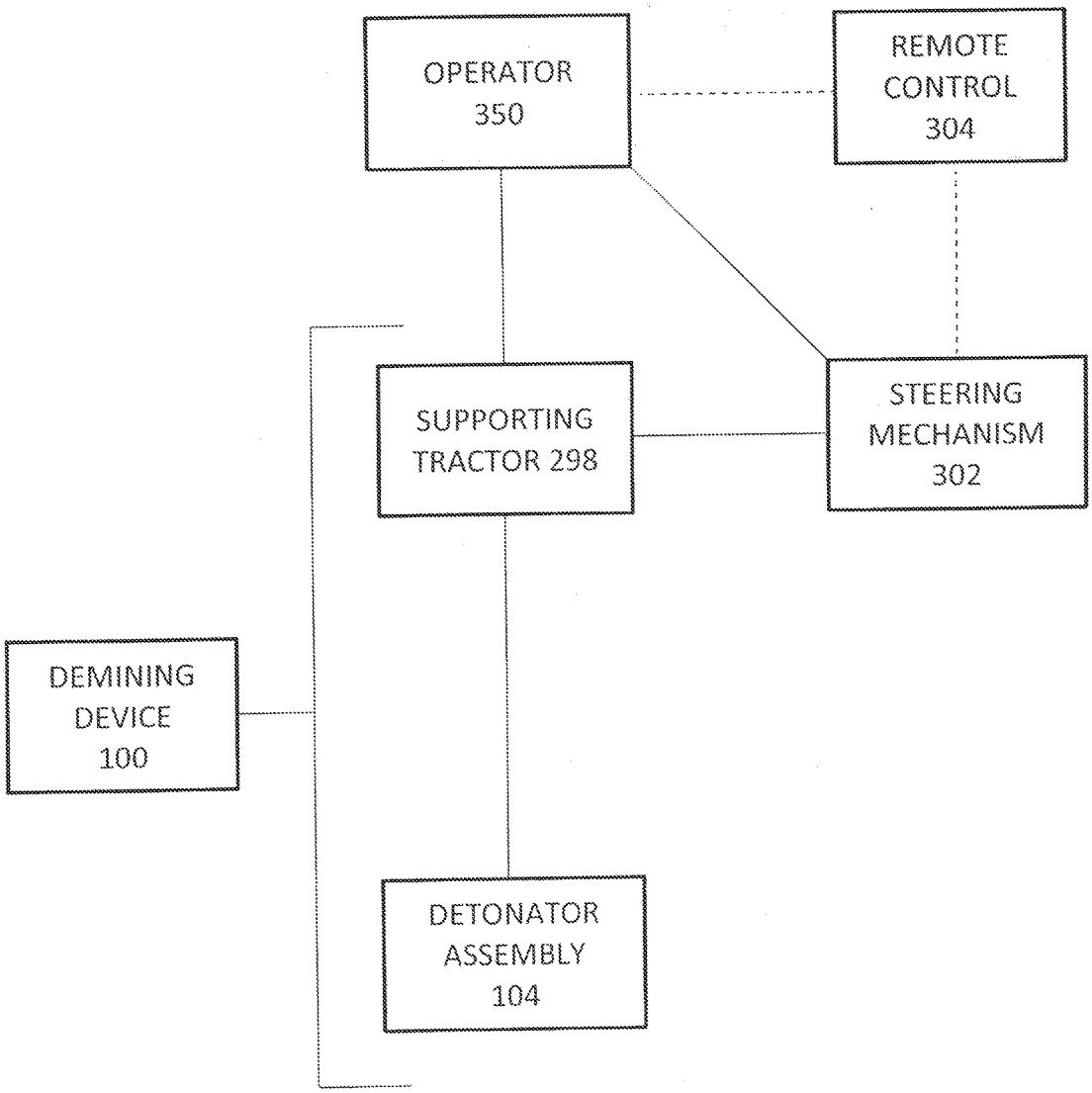
FIG. 14 depicts a box diagram of the demining device 100.

Now considering FIG. 14, the demining device 100 has a supporting tractor 298 with the detonator assembly 104 attached thereto. Operator 350 uses the steering mechanism 302 to direct the supporting tractor 298 and the detonator assembly 104 to desired area. At that time the detonator assembly 104 may be dropped on an area of land in order for the hammer assembly 112 to explode any and all land mines which may be there. Supporting tractor 298 may be any suitable tractor. One type of supporting tractor 298 has a ram drive as above described, but without articulation. Ram drive, articulated tractor 106 is a preferred version of supporting tractor 298.

Figure 12:
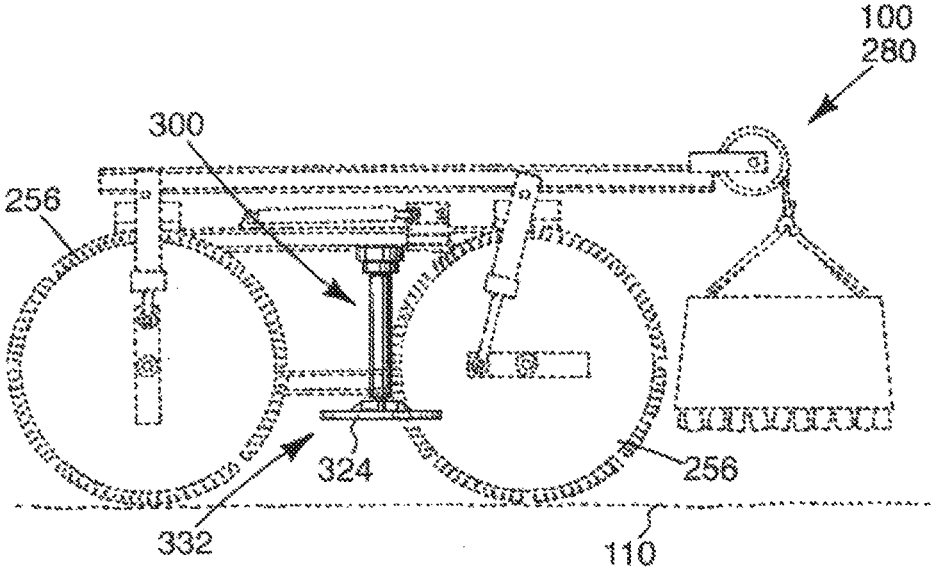
FIG. 12 depicts a side view of ram drive, articulated tractor 106 with a steering pad assembly 300 retracted and mounted thereunder.
Figure 13:
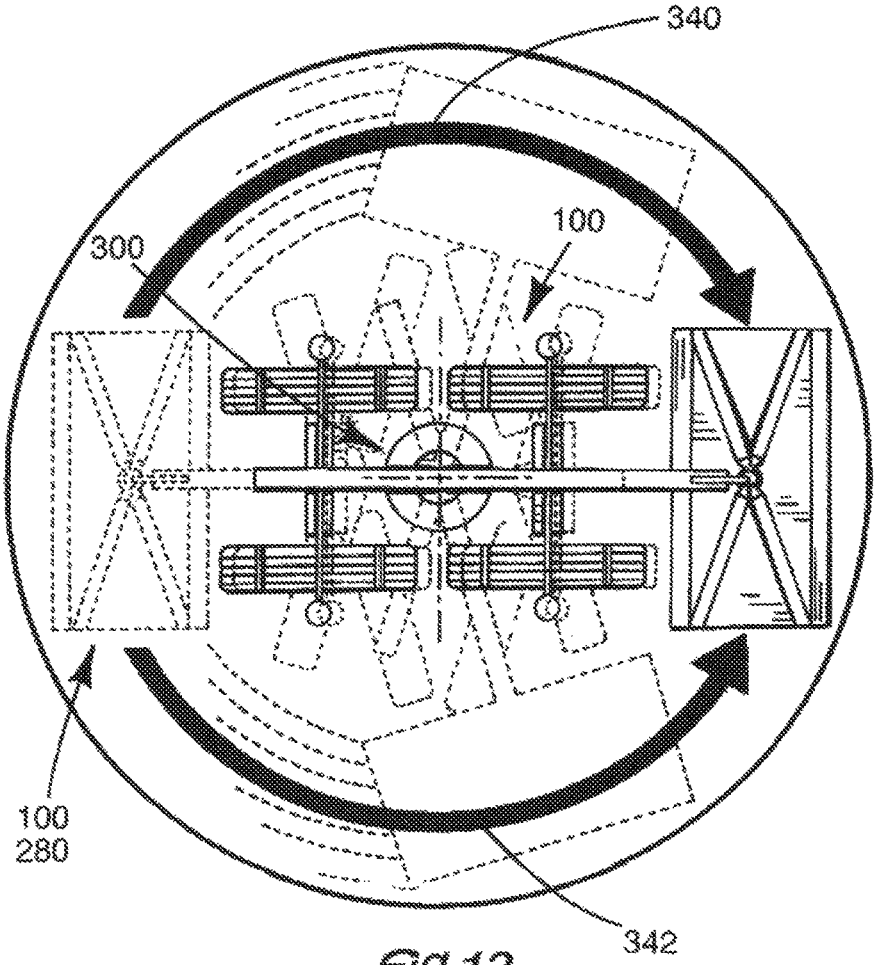
FIG. 13 depicts a bottom plan view of the demining device 100 in general and the ram drive, articulated tractor 106 in particular with a steering pad assembly 300 mounted thereunder.

The steering mechanism 302 may be of any suitable type. The mechanisms described in FIG. 7, FIG. 8, and FIG. 9; and FIG. 10, and FIG. 12 are preferred mechanisms. Such mechanisms can be used separately or together. However, other mechanisms are suitable. The key requirement for the steering mechanism 302 used with the ram drive, articulated tractor 106 (FIG. 1) or supporting tractor 298 (FIG. 14) is to efficiently position the detonator assembly 104 over an area, which may contain mines, and use the detonator assembly 104 to explode the mines with minimal damage to the equipment and no injury to the operator 350.

Getting back to FIG. 14, a remote control 304 for the steering mechanism 302 or the supporting tractor 298 protects and permits the operator 350 to be even more isolated from the danger of mine explosion. Operator 350 can direct demining device 100, while staying an even safer distance from the minefield.

Supporting tractor 298 can be any suitable tractor. A ram drive tractor is preferred. Of course, a more preferred tractor is the ram drive, articulated tractor 106. Supporting tractor 298 must handle the detonator assembly 104 and be efficiently steerable in a mine field. Also, supporting tractor 298 may be manufactured from materials at hand.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this demining device can become clear to a person having ordinary skill in this particular art. Such modifications are clearly covered by this disclosure.

What is claimed and sought to be protected by Letters Patent is:

1. A demining device comprising:

the demining device including a detonator assembly mounted on a ram drive, articulated tractor;

a front drive mechanism on the ram drive, articulated tractor being operably connected to a pair of front wheels for the ram drive, articulated tractor;

a rear drive mechanism on the ram drive, articulated tractor being operably connected to a pair of rear wheels for the ram drive, articulated tractor;

the front drive mechanism being offset relative to the rear drive mechanism;

a front lower wheel mount receiving a front axle;

a rear lower wheel mount receiving a rear axle;

the front lower wheel mount supporting a front strut tower;

the rear lower wheel mount supporting a rear strut tower;

a first hinge shaft cradle beam being supported on the front strut tower;

a second hinge shaft cradle beam being supported on the rear strut tower;

the front strut tower supporting a lift boom for a lift cable;

an upper keel beam resting on the front strut tower and the rear strut tower;

a steering pad assembly permitting effective steering of the ram drive, articulated tractor;

the steering pad assembly having a tractor support pad;

the detonator assembly including a shield capable of contacting a ground surface; and a hammer assembly being contained in the shield as a part of the detonator assembly.

2. The demining device of claim 1 further comprising:

the hammer assembly serving to detonate a contacted land mine;

the lift cable supporting the detonator assembly on the ram drive, articulated tractor;

a control cylinder permitting the lift cable to drop the detonator assembly on the ground surface in order to detonate any mines therein;

the hammer assembly including a plurality of chains;

each member of the plurality of chains having an anchored end and a tethered end oppositely disposed from the anchored end;

the tethered end having a hammer attached to each member of the plurality of chains;

the anchored end for each member of the plurality of chains being received and secured within the shield to form the hammer assembly;

the shield and the hammer assembly forming the detonator assembly;

the lift cable being routed by a guide pulley;

the lift cable being operated from the control cylinder;

the demining device advancing forward in increments based on a depth of the shield for the hammer assembly;

the hammer assembly clearing a mine free path along the surface;

and the ram drive, articulated tractor being remotely controlled.

3. The demining device of claim 2 further comprising:

the shield thereof permitting contact with the hammer assembly;

a support sling holding the hammer assembly on the ram drive, articulated tractor;

the lift cable having a lift coupling at a detonator end thereof;

the lift coupling connecting the lift cable to the hammer assembly;

the control cylinder end permitting a release travel bracket to drop the detonator assembly to the ground surface, thereby causing detonation of any mines under the detonator assembly;

the release travel bracket being adapted to raise the detonator assembly for movement to a next ground surface desired to be cleared of mines;

the control cylinder activating the lift cable;

the control cylinder having a control shaft therein;

the control shaft including a control shaft aperture to receive lift cable, in order to move the detonator assembly up or down as desired;

a pulley bracket supporting a cable pulley;

the cable pulley cooperating with the guide pulley to raise or lower the detonator assembly;

the front strut tower supporting a front drive cylinder;

the rear strut tower supporting a rear drive cylinder;

the front drive cylinder having a front drive end oppositely from a front wheel end;

the rear drive cylinder having a rear drive end oppositely from a rear wheel end;

the front wheel end being connected to one of the pair of front wheels; and the rear wheel end being connected to one of the pair of rear wheels.

4. The demining device of claim 3 further comprising:

the tractor support pad being mounted on a top end of a hydraulic lifting cylinder;

a ground contact pad being mounted on a bottom end of the hydraulic lifting cylinder;

the hydraulic lifting cylinder having a tractor support rod;

the tractor support rod feeding into the hydraulic lifting cylinder;

the tractor support rod being extendable to lift the articulated tractor;

the tractor support pad including a rotating mechanism secured to the hydraulic lifting cylinder at the center thereof, which can rotate the ram drive, articulated tractor in a desired direction when the ram drive, articulated tractor is raised and lower the ram drive, articulated tractor when the rotation is complete;

a lower keel beam for the tractor frame having an upper aperture concentric with a lower aperture to receive the hydraulic lifting cylinder and support the same within the lower keel beam; and the support rod feeding into the hydraulic lifting cylinder at one end thereof and receiving the ground plate at the other end thereof.

5. The demining device of claim 4 further comprising:

the tractor support pad securing the hydraulic cylinder to the ram drive, articulated tractor;

the support rod when deployed permitting the ground plate to contact the ground and lift the ram drive, articulated tractor;

the support rod extending from the hydraulic cylinder to allow for rotation of the demining device; and the offset of front drive cylinder relative to the rear drive cylinder being 80 degrees to 95 degrees.

6. The demining device of claim 5 further comprising the offset of front drive cylinder relative to the rear drive cylinder is 85 degrees to 95 degrees.

7. The demining device of claim 6 further comprising:

the ram drive, articulated tractor being permitted to proceed in the desired direction; and the ram drive, articulated tractor and the demining device thus functioning in a minefield.

* * * * *